United States Patent [19]

Hunt et al.

[11] 4,099,276

[45] Jul. 11, 1978

[54] SUPPORT APPLIANCES HAVING ARTICULATED SECTIONS

[75] Inventors: William Valentine Hunt, Wareham; Frank Edward Mayhew Ducker, London, both of England

[73] Assignee: Watkins & Watson Limited, Wareham, England

[21] Appl. No.: 708,428

[22] Filed: Jul. 26, 1976

[51] Int. Cl.[2] ..... A61G 7/06

[52] U.S. Cl. ..... 5/72; 248/400; 5/67

[58] Field of Search ..... 5/62, 64, 66, 67, 68, 5/72, 69, 77, 78, 91, 327 R, 327 B; 91/390, 419; 92/46, 47; 248/400; 297/318

[56] References Cited

U.S. PATENT DOCUMENTS

| | | | |
|---|---|---|---|
| 3,100,101 | 8/1963 | Trevaskis | 248/400 |
| 3,606,623 | 9/1971 | Aymar | 5/68 |
| 3,781,928 | 1/1974 | Swallert | 5/64 |
| 3,806,192 | 4/1974 | Ohlrogge et al. | 297/318 |
| 3,978,530 | 9/1976 | Amarantos | 5/66 |

*Primary Examiner*—Kenneth J. Dorner
*Attorney, Agent, or Firm*—Russell & Nields

[57] ABSTRACT

A support appliance, such as a bed, having an articulated head section is disclosed in which the head section is raisable pneumatically using a bellows and the appliance includes a pneumatic control valve which automatically feeds air to the bellows to compensate for air losses inadvertently occurring in the system and thereby maintains the head section in a predetermined raised attitude.

7 Claims, 6 Drawing Figures

SUPPORT APPLIANCES HAVING ARTICULATED SECTIONS

BACKGROUND OF THE INVENTION

This invention relates to support appliances, such as beds, having articulated sections and in particular provides a pneumatic system for causing articulation of the sections.

In U.S. Pat. No. 3,909,858 to Frank E. M. Ducker (the disclosure of which is incorporated herein by reference) a support appliance, such as a bed, is described in which the patient support surface consists of a number of air sacs or cells which are inflated to various pressures depending upon the weight to be supported at different points along the bed. By adjusting the pressures in different cells or groups of cells in this way, the incidence of bed sores can be reduced and the healing process in the case of patients having burns or other lesions can be accelerated. The appliance described in the above U.S. Patent also provides for the circulation of thermostatically controlled air through the cells so that the maintenance of optimum temperature of the patient can be facilitated. In addition, the above mentioned U.S. Patent contemplates an articulated construction in which the head and foot section are pivotable with respect to a center section. This is an important feature which greatly reduces the physical labour necessary in the nursing of seriously ill patients. Various mechanical, hydraulic and electromechanical systems have been investigated for raising and lowering sections of hospital beds and similar support appliances but such systems mostly suffer from the disadvantages of excessive complexity and expense, particularly where more than one pivoting action is required.

SUMMARY OF THE INVENTION

The present invention is concerned with a support appliance, such as a hospital bed, having articulated sections in which at least one section is raisable pneumatically by means of a bellows, the raisable section having a hinged connection with the adjacent section which allows relative movement of the pivoting sections longitudinally of the appliance during relative angular movement. A hinged connection of this kind prevents jamming of the pivoting sections by compression of air cells or sacs forming the patient support surface in the region of the pivot. The bellows system contemplated by the present invention consists essentially of a bellows disposed beneath the head section which is raised by low pressure air (e.g. 5 to 15 inches water gauge) on operating a three-way actuating valve having feed, hold and exhaust positions, the head section being maintained in its raised position by means of the volume of air trapped in the actuating bellows.

A similar arrangement may be provided for the foot section. It has been found, however, that a particular problem arises with this simple and otherwise very effective system as a result of the great difficulty in producing on a production basis, a bellows and supply system which is 100% airtight. Even a very small leak in the bellows or its air supply system will result in the hinged head or foot section of the bed collapsing after a few hours. It is to the solution of this problem that the present invention is specifically directed, although the invention will also find application in other pneumatic systems in which low pressure air is used as an operating fluid.

According to the present invention there is provided a pneumatic actuating system for controlling the attitude of an articulated support appliance wherein an inflatable bellows is provided to cause articulation of the appliance, said system comprising a control valve disposed between the bellows and a source of pressurized air, said control valve being arranged to feed air automatically to said bellows as required to maintain the bellows in a predetermined inflated condition.

Various means may be provided to enable the control valve to sense deflation of the bellows and thereby actuate the valve to feed the necessary compensatory volume of air to the bellows. For the particular use discussed above, namely in bed construction, it has been found that the most convenient way of achieving this is to connect the valve to the hinged portion of the bed by a mechanical connection such as a line and pulley system. The line and pulley system is particularly advantageous since it is able to accommodate the movement of the hinged part relative to the fixed part of the bed which arises from the fact that the axis about which the hinged portion pivots is not fixed; this moveable axis being important since otherwise the inflated sacs, which preferably form the patient support surface, tend to prevent the desired pivoting movement.

DESCRIPTION OF THE PREFERRED EMBODIMENTS

Figure 1:
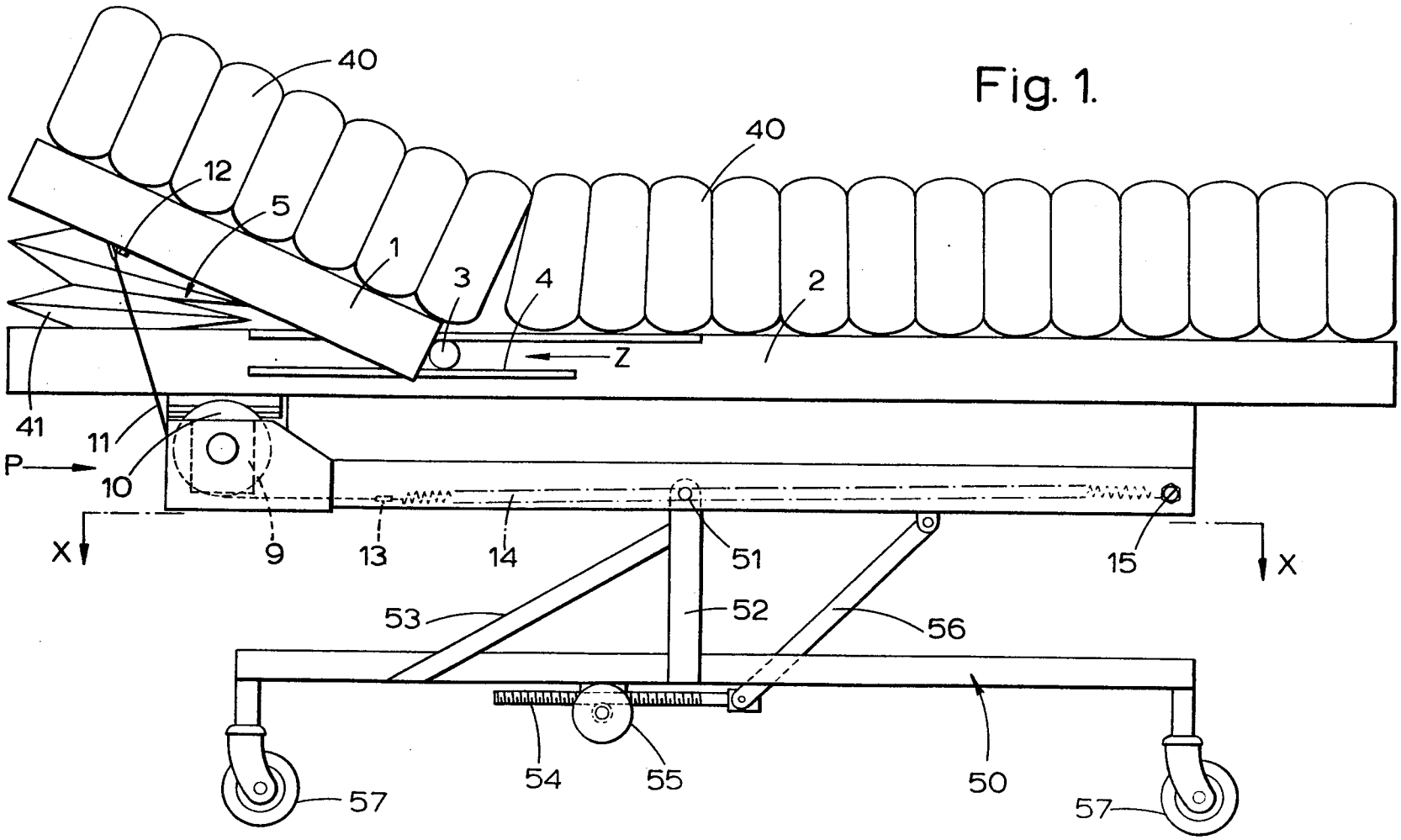
FIG. 1 is a partial elevation of a bed of the general type described in U.S. Pat. No. 3,909,858 fitted with a control valve in accordance with the invention.
Figure 2:
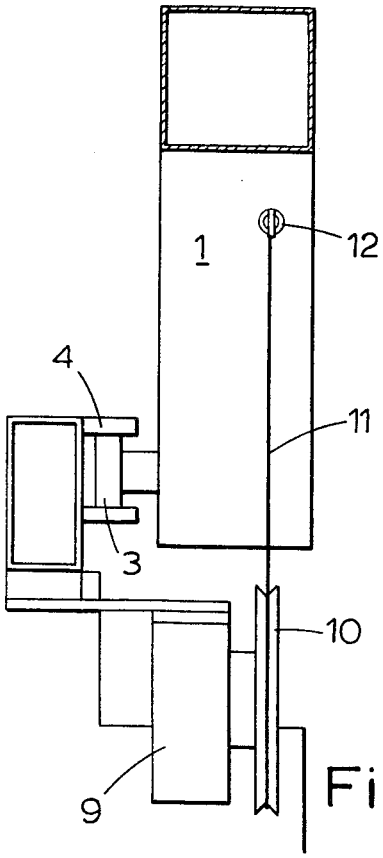
FIG. 2 is a part elevation taken in the direction of the arrow P in FIG. 1.
Figure 3:
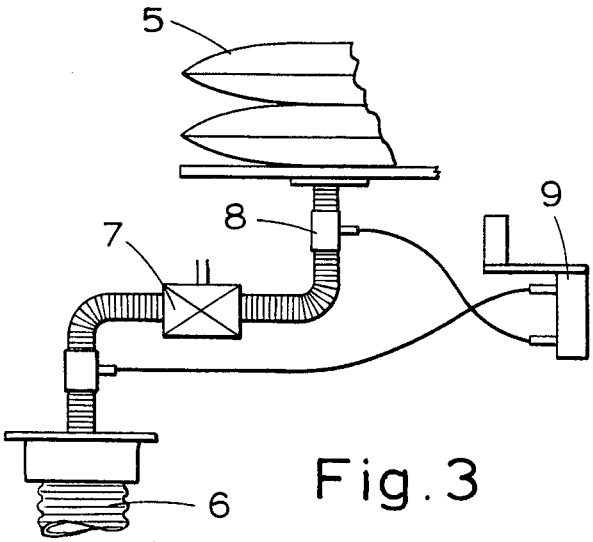
FIG. 3 shows diagrammatically the air connections for feeding air to the bed shown in FIGS. 1 and 2.

Referring to FIGS. 1, 2 and 3 of the drawings, the bed comprises a head section 1 which is hingedly connected to the main section of the bed 2 by means of a pivot 3 which is free to move along a track 4 in the direction shown by the arrow Z when the part 1 is hinged upwardly. In the bed illustrated in the drawings, the air cells or sacs which form the patient support surface are mounted on the frame sections 1 and 2 and are shown at 40. Such cells or sacs may be mounted on the sections by one of the methods described in U.S. Pat. No. 3,909,858 and are connected to a source of thermostatically controlled pressurized air.

Upward movement of the head section 1 is effected by supplying air under pressure to bellows 5 disposed between head section 1 and the main section 2. The air circuit diagram is shown in FIG. 3 from which it will be seen that the bellows 5 are supplied with air from an air supply conduit 6 via a bellows actuating valve 7 and an inlet tube 8. The automatic control valve 9 is connected across the actuating valve 7 for a purpose which will be described later. Conduit 6 may be connected to a centrifugal or axial air fan supplying pressurized air to the air sacs 40 as well as to the valve 7.

In normal operation of the bellows 5, the actuating valve 7 is opened to supply air to the bellows 5. Once the head section 1 of the bed has been raised to the desired position, valve 7 is closed so as to maintain air in the bellows 5. Valve 7 is a three-port valve, the third port being to atmosphere so that when it is desired to lower the head section 1, valve 7 is opened to atmosphere to allow air to escape. Valve 9 is provided to maintain air in the bellows 5 when in its inflated condition and to compensate for any leakages occurring in the system between the valve 7 and the bellows 5.

The automatic control valve 9 is located beneath the main section 2 of the bed and is actuated by a wire and pulley system as follows. A pulley 10 is mounted on the end of the rotatable portion of the valve 9 and drives the valve 9 via a friction clutch device which is described in greater detail below. One end of a wire cable is anchored at 12 to the head section 1 of the bed. Cable 11 is passed in one complete turn around pulley 10 and the other end 13 secured to a spring 14, the free end of the spring 14 being secured at 15 to the main part 2 of the bed. The arrangement of the ports in the valve 9 and the drive to the valve 9 via the pulley and cable system is such that when the head section 1 of the bed is raised, the valve 9 is rotated to its closed position and all the air from the supply 6 consequently passes through the actuating valve 7. When the valve 9 reaches its closed position, the friction clutch slips and allows the pulley to rotate while the rotatable portion of the valve remains stationary. When the head section 1 of the bed begins to fall, e.g. because of a slight leak in the system, the pulley is rotated in the other direction by the taut wire 11 and this angular movement is transmitted to the valve 9 by the friction clutch so that valve 9 is opened slightly. Air is then fed from the supply 6 through valve 9 into the inlet tube 8 until the head section 1 rises to the predetermined position, whereupon the valve 9 is closed again by rotation of the pulley in the opposite direction.

Figure 4:
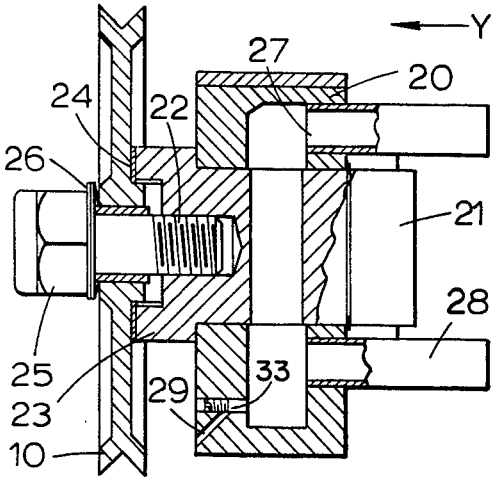
FIG. 4 is an axial section through the control valve and, FIG. 5 is an elevational view of the control valve shown in FIG. 4 taken in the direction shown by the arrow Y of FIG. 4.
Figure 5:
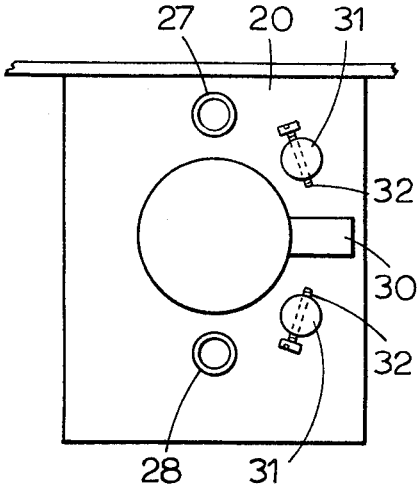

The construction of the control valve 9 itself and its associated friction clutch is shown in FIGS. 4 and 5. Referring to these figures the valve comprises a static body section 20 fixed by a bracket to the main section of the bed and having a bore arranged to receive the rotatable portion 21 of the valve 9. The pulley 10 is mounted on a bushed stud 22, the bush enabling the pulley to rotate on the stud. One end of the stud 22 is secured to the portion 21 so that stud 22 rotates with the portion 21. The rotatable portion 21 has an integral boss 23 which has an annular face adapted to contact the rear face of the pulley 10 via a friction washer 24. The pulley 10 is retained on the bushed stud by means of a nut 25 and spring washers 26. It will be appreciated that the turning force which the resultant friction clutch is able to transmit before it slips can be controlled by the degree by which the nut 26 is tightened onto the stud 22. The static body section 20 is provided with an inlet 27 and an outlet 28 and a small port 29 closeable with a screw 33 is provided to enable a controlled leakage of air from the bellows system to be arranged. Rotatable portion 21 is provided with a groove or a hole to enable ports 27 and 28 to be connected. Rotation of portion 21 of the valve is limited by a spring dowel 30 which projects radially from the part of rotatable section 21 which projects beyond the confines of the body 20 remote from pulley 10. (See FIG. 5). Dowel 30 allows the valve to rotate through a small sector defined by two tubes or studs 31 which are secured in the body 20. The walls of tubes or studs 31 are threaded to accommodate screws 32 to enable fine adjustment of the degree of freedom of movement of the dowel 30 and hence the valve section 21. The angular relationship of the groove or hole through section 21 with the inlet and outlet ports 27 and 28 in the body 20 is such that when the head section A of the bed is in the fully raised position valve 9 is just closed. The screws 32 are then adjusted to allow the bed to fall by a short distance before valve 9 opens to admit air to the bellows 5. Port 29 is provided to allow a controlled leak to be provided in a system where the natural leak is too small to actuate the valve 9.

A feature of the bellows construction is that each of the cushion sections 41 of the bellows include means for ensuring that the cushion sections, which make up the bellows, inflate simultaneously when the bellows are connected to the compressed air supply. This may be achieved by providing a spacer of porous material e.g. foamed plastics or rubber or a plastics mesh inside the cushion sections in the areas interconnecting the adjacent sections. Such spacers of plastics foam or mesh need be no more than 1/16 to ¼ inch thick and function by preventing the fabric of the cushion sections sealing together by air pressure. It has been found that in the absence of spacers of this kind only one cushion section at a time will inflate (resulting in uneven and jerky inflation) rather than all cushion sections simultaneously.

Figure 1A:
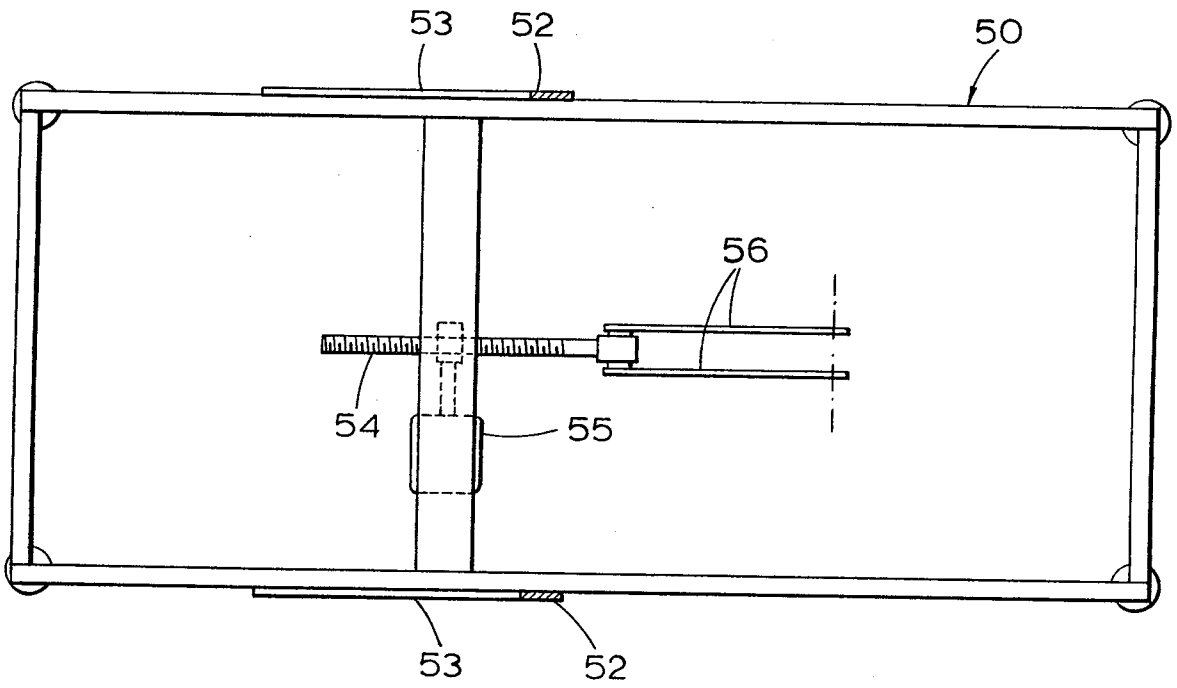
FIG. 1*a* is a view taken on the line X—X in FIG. 1.

A further feature of the support appliance according to the invention is that the entire appliance is pivotally mounted on a trolley 50 so that the appliance can be pivoted to any desired angle. The arrangement for achieving this is indicated in FIGS. 1 and 1*a* from which it can be seen that the center section 2 is pivotally mounted on an axle 51 supported in bearings on a post 52 at each side of the center section. Posts 52 are mounted on trolley 50 and braced by struts 53. Mounted on a transverse bar of the frame of the trolley 50 is a screw jack 54 which is arranged to extend and retract approximately along the center line of the trolley frame. The main body of the screw jack and its associated electric motor 55 for driving it are secured to the transverse bar, while the screw thread of the jack is coupled to one end of a lever 56 which is connected at its other end to the center section 2 of the bed. It will be appreciated that extension of the screw thread will cause the head section to tilt upwardly, while retraction will have the opposite effect. The trolley includes castor wheels 57 of which at least one is fitted with a foot-operated brake (not shown).

Where the bed includes a pneumatically raisable foot section a further control valve 9 may be provided to ensure an automatic supply of air to the foot section actuating bellows. In general, however, it has been found that this is not normally necessary because the weight which the raised foot section is required to support is usually much less than the head section.

While the invention has been described with particular reference to a bed having articulated sections, it will be appreciated that the invention is equally applicable to any pneumatic system in which low pressure air is used as an operating fluid.

We claim:

1. Apparatus for maintaining a raisable member in a predetermined raised position with an inflatable bellows, comprising:

a bellows adapted to support said member, a pressure source, a first conduit having a first valve therein and connected between said bellows and said pressure source, a second conduit having a second valve therein and connected between said bellows and said pressure source, said first valve including a rotatable conduit rotatable between a valve-open and a valve-closed position, a pulley frictionally engaging said rotatable conduit whereby rotation of said pulley in one sense rotates said rotatable conduit from said valve-open position to said valve-closed position but no further and rotation of said pulley in the opposite sense rotates said rotatable conduit from said valve-closed position to said valve-open position but no further, and a line connected to said raisable member and passed around said pulley in such a manner that if said member falls from said predetermined position, said line rotates said first valve from a valve-closed to a valve-open position, thereby admitting pressurized air to said bellows and restoring the raisable member to its predetermined position.

2. Apparatus according to claim 1 in which the rotatable conduit of said first valve is formed in a body member which is rotatable between abutments, said abutments being adjustable to allow the raisable member to fall by a finite distance before said first valve rotates from said valve-closed position to said valve-open position.

3. Apparatus according to claim 1 in which the frictionally engaging pulley and first valve constitutes a friction clutch enabling the pulley to slip with respect to the first valve whenever there is a tendency for said pulley to rotate said first valve past its valve-closed or valve-open position.

4. Apparatus according to claim 1 in which the line is connected at one end to the raisable member, passes around the pulley and is connected at its other end via tensioning means to an anchorage.

5. Apparatus according to claim 1 in which said first conduit includes means for providing a controlled leak from said bellows, said leak being sufficient to cause occasional actuation of said first valve.

6. A support appliance, such as a bed, having a head section which is raisable and lowerable with respect to an adjacent section using an inflatable bellows, said appliance including means for maintaining the head section in a predetermined raised position, which comprises;

a bellows adapted to support said head section, a pressure source, a first conduit having a first valve therein and connected between said bellows and said pressure source, a second conduit having a second valve therein and connected between said bellows and said pressure source, said first valve including a rotatable conduit rotatable between a valve-open and a valve-closed position, a pulley frictionally engaging said rotatable conduit whereby rotation of said pulley in one sense rotates said rotatable conduit from said valve-open position to said valve-closed position but no further and rotation of said pulley in the opposite sense rotates said rotatable conduit from said valve-closed position to said valve-open position but no further, and a line connected to said head section and passed around said pulley in such a manner that if said head section falls from said predetermined position, said line rotates said first valve from a valve-closed to a valve-open position, there admitting pressurized air to said bellows and restoring the head section to its predetermined position.

7. A support appliance according to claim 6 which has a supporting surface for an occupant comprising a plurality of inflatable air sacs.

* * * * *